US008096065B2

(12) United States Patent
Marechal et al.

(10) Patent No.: US 8,096,065 B2
(45) Date of Patent: Jan. 17, 2012

(54) BUCKLE FOR FASTENING A SPORTS BOOT

(75) Inventors: Pierre Alexis Marechal, Annecy (FR); Stéphane Plassiard, La Cote d'Aime (FR)

(73) Assignee: Salomon S.A.S., Metz-Tessy (FR)

( * ) Notice: Subject to any disclaimer, the term of this patent is extended or adjusted under 35 U.S.C. 154(b) by 1010 days.

(21) Appl. No.: 12/029,662

(22) Filed: Feb. 12, 2008

(65) Prior Publication Data

US 2008/0189922 A1 Aug. 14, 2008

(30) Foreign Application Priority Data

Feb. 13, 2007 (FR) ..... 07 01004

(51) Int. Cl.
*A43B 5/04* (2006.01)

(52) U.S. Cl. ..... 36/50.5; 24/70 SK; 24/71 SK

(58) Field of Classification Search ..... 36/50.5; 24/70 SK, 71 SK, 68 SK
See application file for complete search history.

(56) References Cited

U.S. PATENT DOCUMENTS

| | | | | |
|---|---|---|---|---|
| 3,401,432 A | | 9/1968 | Tresenreiter | |
| 3,662,435 A | * | 5/1972 | Allsop | 24/70 SK |
| 4,453,290 A | | 6/1984 | Riedel | |
| 5,416,952 A | * | 5/1995 | Dodge | 24/68 R |
| 5,509,180 A | | 4/1996 | Benetti et al. | |
| 5,669,122 A | * | 9/1997 | Benoit | 24/71 SK |
| 6,145,168 A | * | 11/2000 | Baggio et al. | 24/70 SK |
| 6,748,630 B2 | * | 6/2004 | Livingston | 24/68 SK |
| 7,086,122 B2 | * | 8/2006 | Livingston | 24/71 SK |
| 2008/0189922 A1 | * | 8/2008 | Marechal et al. | 24/68 SK |

FOREIGN PATENT DOCUMENTS

| | | |
|---|---|---|
| DE | 1 685 816 A1 | 5/1971 |
| DE | 202 11 689 U1 | 3/2003 |
| EP | 1 086 629 A1 | 3/2001 |
| FR | 2 495 903 A1 | 6/1982 |
| FR | 2 708 429 A1 | 2/1995 |

* cited by examiner

*Primary Examiner* — Ted Kavanaugh
(74) *Attorney, Agent, or Firm* — Greenblum & Bernstein, P.L.C.

(57) ABSTRACT

A fastening buckle adapted to bring a first side loser to a second side, including a cap fixed on the first side, a lever pivotally mounted about a first axis relative to the cap, a tie rod pivotally mounted on the lever about a second axis, the first axis being actuated, during tightening, by a translational movement with respect to the first side. An attachment rack is fixed on the second side; a latch is affixed to the tie rod, such that the latch, when closed, is engaged with one of the teeth of the rack. The cap includes two parallel side members in each of which an elongated opening is arranged. A slot is arranged in the lever between two legs; the first axis is defined by two rivets, each of the rivets fixing one of the legs to one of the side members by extending through the elongated opening so as to enable the translational movement of the lever with respect to the first side. A pinion equipped with a plurality of teeth is arranged at the end of each of the legs; the cap includes a support rack, and the teeth of the pinion are engaged with the teeth of the support rack so that the pivoting movement of the lever about the first axis generates a translational movement of the first axis with respect to the cap.

12 Claims, 4 Drawing Sheets

17
1
21
24
4
23
3
22
20
2

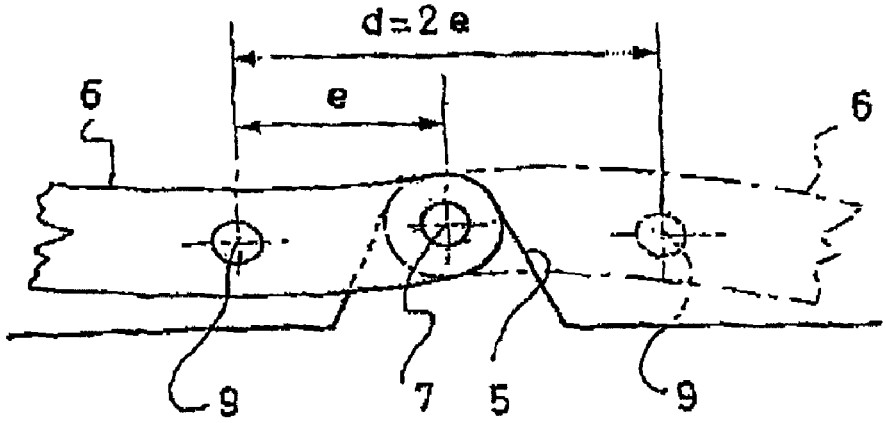
Fig. 5
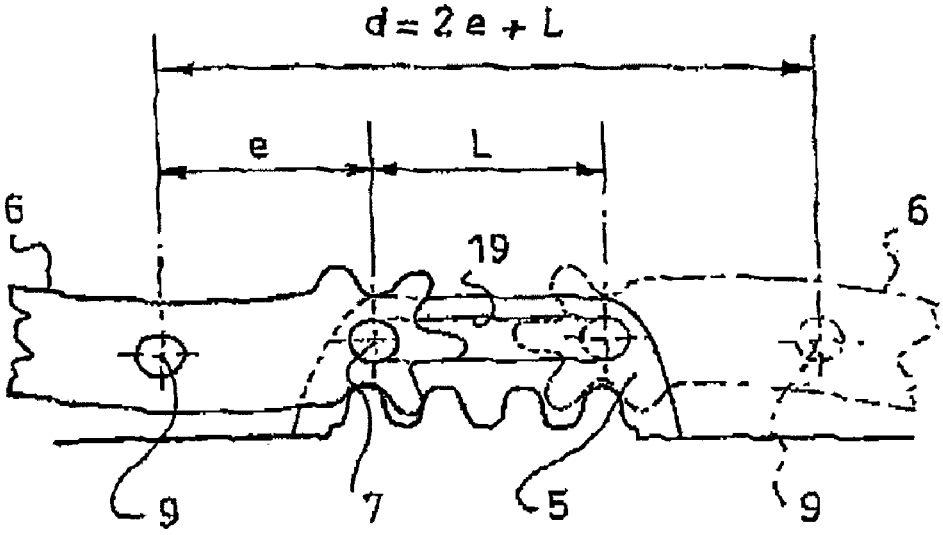

BUCKLE FOR FASTENING A SPORTS BOOT

CROSS-REFERENCE TO RELATED APPLICATION

This application claims priority under 35 U.S.C. §119 of French Patent Application No. 07 01004, filed on Feb. 13, 2007, the disclosure of which is hereby incorporated by reference thereto in its entirety.

BACKGROUND OF THE INVENTION

1. Field of the Invention

The invention relates to fastening buckles using a manipulation lever and provided to bring two sides closer together. More particularly, the invention relates to buckles for fastening sports boots for closing and/or tightening portions of a boot around the foot or lower leg of a wearer, as well as to a boot having such buckle(s).

2. Description of Background and Other Information

Buckles of the aforementioned type are especially used for fastening ski boots. However, they can be used for any other items, such as skate boots, boot bindings for a gliding board, luggage closures, etc.

To fasten sports boots having a rigid shell, such as an alpine ski boot, it is known to use metallic buckles, which are used to bring two sides of the shell closer together and to keep them tightened. Typically, buckles of this type are fixed on one of the two sides of the shell. An attachment rack equipped with a plurality of teeth is attached to the other side of the shell. To tighten, the latch of the buckle is engaged with one of the teeth of the rack; a device in the buckle then enables the latch to be displaced by an amplitude "d", referred to as the tightening amplitude. To displace the latch along the tightening amplitude, it is commonly known to use so-called knuckle-joint, or over-center, mechanisms.

In a knuckle-joint mechanism, the buckle includes a cap fixed to the first side, as well as a lever pivotally mounted about a first axis relative to the cap. The buckle also includes a tie rod, or linking rod, that is pivotally mounted on the lever about a second axis. The tie rod is affixed to the latch, the connection between the tie rod and the latch being capable of being articulated about a third axis. In order for the buckle to work, the first axis and the second axis must not be coaxial. In practice, the distance "e" separating the first axis from the second axis determines the maximum tightening amplitude. Indeed, the maximum tightening amplitude "d" is equal to twice the distance "e", which separates the first axis from the second axis. Furthermore, in order for the buckle to function according to the knuckle-joint principle, the position of the second axis must be beneath a plane of equilibrium when the buckle is closed. The plane of equilibrium is the plane that contains the first axis, and which passes through the connection point between the tie rod and the latch.

To increase the tightening amplitude, the distance separating the first axis from the second axis can be increased. This solution has a number of drawbacks.

For example, when the distance separating the first axis from the second axis is increased, the torque that must be applied by the lever in order to tighten is thereby increased. However, such buckles are adapted to be manipulated by hand, and too substantial a torque for actuating the buckle is problematic for users who do not have adequate physical strength.

To solve this problem, prior art systems have been proposed to assist in tightening. The document DE 202 11 689 describes such a device, which is a lever extender. It includes a hollow portion adapted to receive the free end of the lever. The user therefore slips this tool on the lever in order to lengthen the lever and, therefore, to obtain a more substantial lever arm. This provides the user with the ability to apply a greater tightening fore.

This solution is not satisfactory as it requires using an additional tool that the user must carry around. Furthermore, the tool must be dedicated to the buckles of the boot, as there is no guarantee that such an adapter would function on all types of buckles, each buckle having a particular lever shape.

U.S. Pat. No. 6,145,168 describes another solution to the aforementioned problem. The buckle described in this document has an additional lever that is pivotally mounted on the main lever and makes it possible to extend the main lever. This solution is no more satisfactory then the previously mentioned solution insofar as it requires learning how the lever functions. Indeed, the functioning of such a lever is slightly different from the functioning of a conventional lever. The user must first pivot the additional lever, such pivoting movement being done in a direction that is opposite the pivoting direction of the main lever.

SUMMARY OF THE INVENTION

The present invention provides a buckle that overcomes the drawbacks of the prior art.

In addition, the present invention provides a buckle having an improved tightening amplitude.

Further, the invention provides a buckle that offers tightening assistance to the user.

In a particular embodiment, the invention provides a fastening buckle adapted to bring a first side of an article to be tightened and/or closed closer to a second side, including a cap fixed to the first side, a lever pivotally mounted about a first axis relative to the cap, a linking rod pivotally mounted on the lever about a second axis, the first axis being actuated by a translational movement relative to the first side during tightening.

Due to the translational movement of the axis, about which the lever pivots, the tightening amplitude can be increased without increasing the force that is necessary to manipulate the buckle. Also, the tightening force can be assisted by reducing the distance that separates the first axis from the second axis, while maintaining a sufficiently large tightening amplitude.

In a particular embodiment, the fastening buckle according to the invention includes an attachment rack, such as a toothed rack, fixed on the second side, as well as a latch affixed to the linking rod, such that the latch, when closed, is engaged with one of the teeth of the rack.

In a particular embodiment of the buckle according to the invention, the cap includes two parallel side members, in each of which an elongated opening is arranged.

In a particular embodiment, in the buckle according to the invention, a slot is arranged between two legs in the lever, the first axis being defined by two rivets, each of the rivets fixing one of the legs to one of the side members by extending through the elongated openings so as to enable the translational movement of the lever with respect to the first side.

In a particular embodiment, in the buckle according to the invention, a pinion equipped with a plurality of teeth is arranged at the end of each of the legs, the cap includes a support rack, and the teeth of the pinion are engaged with the teeth of the support rack, so that the pivoting movement of the lever about the first axis generates a translational movement of the first axis with respect to the cap.

BRIEF DESCRIPTION OF DRAWINGS

The invention will be better understood from the description that follows, with reference to the attached drawings, in which:

FIG. 5 is a top view of the buckle according to the invention, in a closed position.

DETAILED DESCRIPTION OF THE INVENTION

Figure 1:
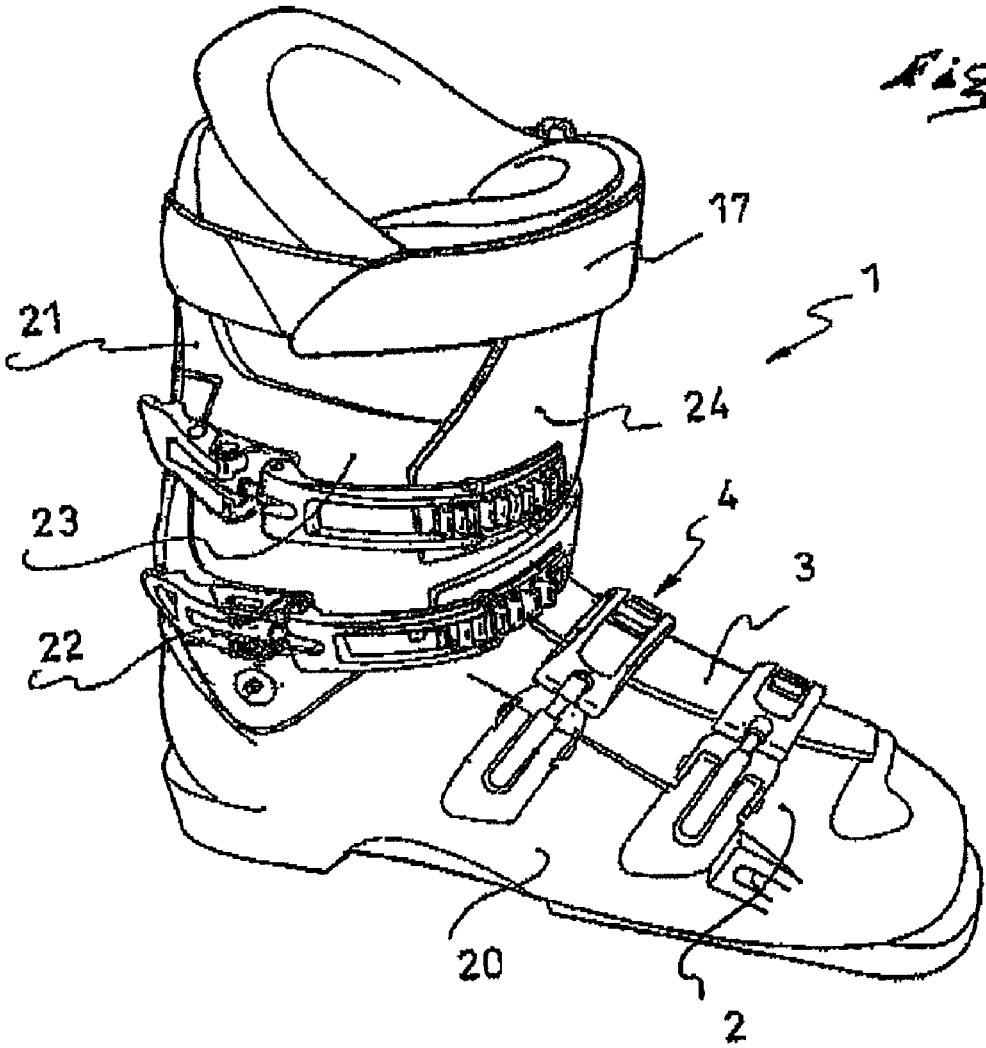
FIG. 1 is a perspective view of a sports boot according to the invention.

FIG. 1 shows a perspective view of a ski boot 1 according to the invention. It includes a shell base 20 and a collar 21 made of a plastic material. The shell base 20 includes an opening that is closed by two flaps, the first flap 2 and the second flap 3, which overlap one another and are maintained in place by conventional buckles 4. The collar 21 envelopes the lower leg and includes a conventional buckle of the same type as the buckles 4 positioned on the shell base, an improved buckle 22 according to the invention, and a tightening strap 17 positioned at the top of the collar 21. In the embodiment disclosed here, only one of the buckles is an improved buckle 22 according to the invention, the others being conventional buckles as known in the prior art. The number of buckles on the boot or the distribution between conventional buckle and improved buckle is in no way a limiting characteristic of the invention, insofar as boots provided with only three or two buckles can be envisioned according to the invention, or boots in which only two, three, or four in the set of buckles on the boot are improved buckles according to the invention.

Figure 2:
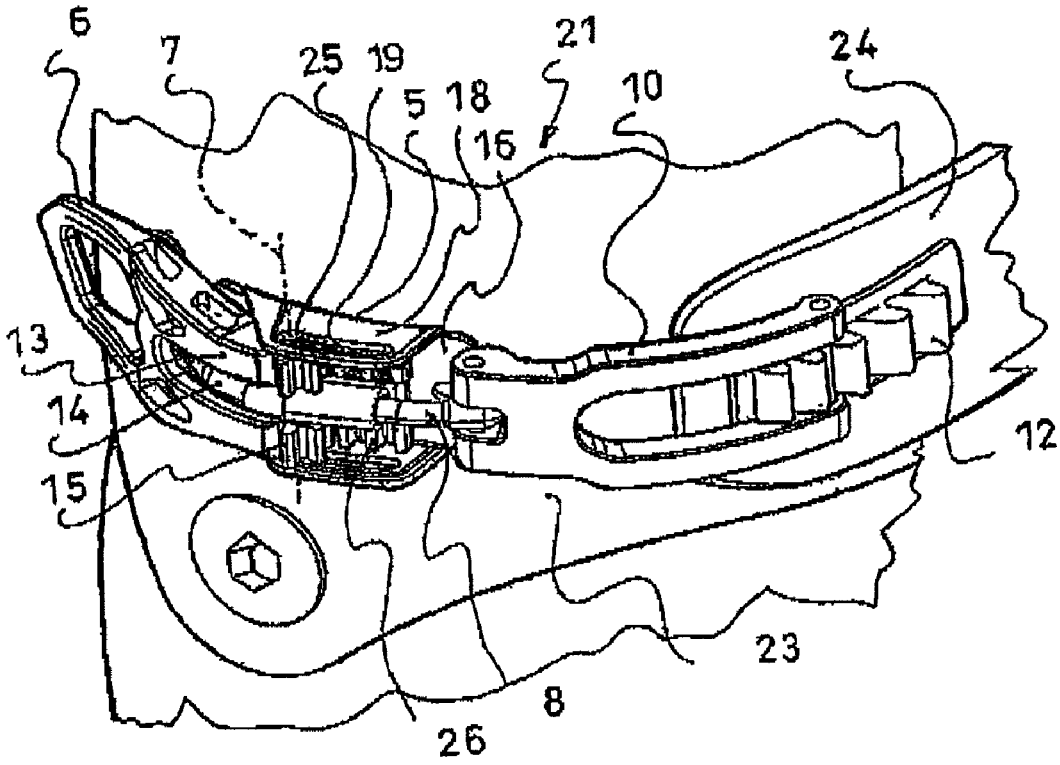
FIG. 2 a detailed view of a buckle according to the invention.

FIG. 2 shows a perspective view of the improved buckle 22 as positioned, on the collar 21. The collar includes a cap 5, which is fixed on a first side 23 of the collar 21 by any expedient, such as glue, a screw, a rivet, etc. It also includes a lever 6, a linking rod 8, and a latch 10.

An attachment rack 12, i.e., a toothed rack, is fixed on a second side 24 of the collar 21. In the closed position of the buckle, as shown in FIG. 2, the free end of the latch 10 is engaged with one of the teeth of the rack 12

Figure 3:
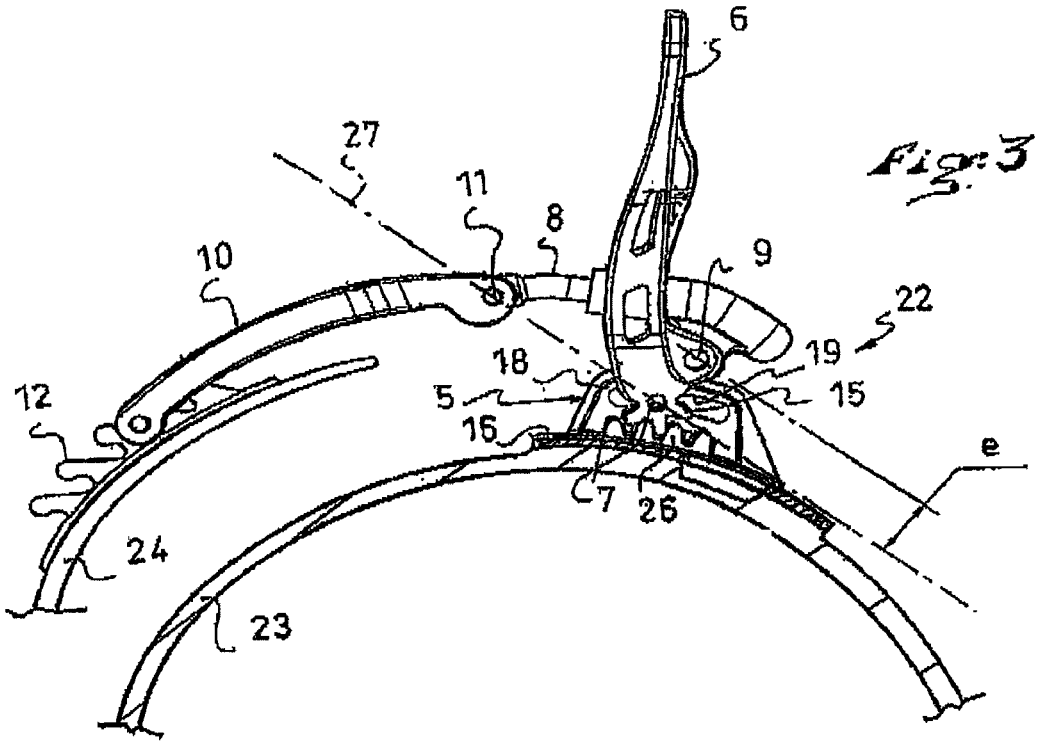
FIG. 3 is a schematic view comparing the functioning of a conventional buckle to the functioning of a buckle according to the invention.

FIG. 3 shows a top view of the improved buckle 22. The lever 6 can pivot with respect to the cap 5 about a first axis 7. A slot 14 (see FIG. 2) provided in the lever 6 define two legs 13. A pinion 15 is arranged at the end of each leg. Each of the pinions 15 is constituted of a plurality of concentric teeth centered on the first axis 7. The first axis 7 is defined by two rivets 25, which fix the cap 5 to respective ones of the legs 13.

The cap 5 includes a base 16 that is pressed against the first side of the collar and two side members 18 that project from the base, perpendicular thereto. The two side members 18 are parallel to one another and are spaced apart by a distance that is equal, or approximately equal, to the width of the lever in the area of the legs 13. An elongated opening 19 is arranged in each of the side members. Each of the rivets 25 that define the first axis 7 passes through one of the legs, through one of the side members, and through the elongated opening 19. Because each of the rivets 25 extend within one of the elongated openings 19, the first axis 7 can translate along the elongated opening 19, i.e., the first axis moves in a direction generally along the surface of the side 23. Therefore, there is a possibility of relative translational displacement between the lever 6 and the cap 5.

Furthermore, the base 16 of the cap 5 includes, or carries, a support rack 26 having a succession of teeth. The teeth of the support rack 26 are engaged with the teeth of the pinion 15. Thus, the rotation of the lever 6 about the first axis 7 automatically causes the longitudinal displacement of the first axis, and therefore of the lever 6, in the elongated opening 19.

The linking rod 8 is pivotally mounted on the lever 6, about a second axis 9. The distance separating the first axis 7 from the second axis 9 is a non-zero value "e". The second axis 9 is set back with respect to the end of the lever in which the pinions 15 are located. Because of the presence of the slot 14, the linking rod 8 can remain in a practically constant position throughout the combined rotational and translational movement of the lever 8. Indeed, one of the ends of the linking rod 8 is in the slot 14 at any time. The other end of the linking rod is connected to the latch 10 by means of a third axis 11.

Figure 4:
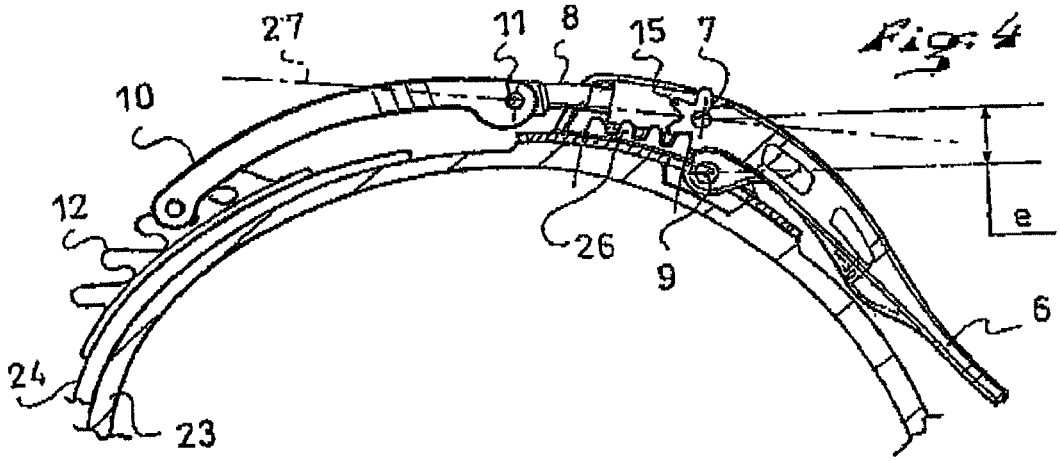
FIG. 4 is a top view of the buckle according to the invention, in an open position.

FIGS. 3 and 4 show the buckle according to the invention in two successive positions. In FIG. 3, the buckle is in the intermediate position, between the closed position and a completely open position. In this position, the teeth of the pinion, which are engaged with the teeth of the support rack, are engaged with the central teeth of the support rack. The second axis 9 is positioned above the plane of equilibrium 27, which is the plane defined by the first axis 7 and the third axis 11, these axes being parallel to one another.

FIG. 4 shows the buckle in the closed position, applying a tensioning force to the first and second sides 23, 24. The second axis 9 is then positioned beneath the plane of equilibrium 27. This position of the second axis 9 guarantees that the buckle remains in the closed position.

FIG. 5 offers a schematic comparison between the functioning of a conventional buckle 4 according to the prior art and the functioning of an improved buckle 22 according to the invention. In the upper portion of the drawing figure, the functioning of a conventional buckle can be seen. The solid line represents the position of the lever when the buckle is in the open position. The dotted lines represent the position of the lever, when the buckle is in the dosed position. The maximum tightening amplitude "d" is shown to be determined by twice the distance separating the first axis 7, which corresponds to the articulation axis of the lever 6 on the cap 5, from the second axis 9, which corresponds to the articulation axis of the tie rod 8 on the lever 6. In this case, in order to be able to increase the tightening amplitude "d", it is necessary to increase the value "e" corresponding to the distance between the first axis and the second axis. Conversely, the increase in the value "e" causes a substantial increase in the force that is necessary to manipulate the tightening lever.

In the lower part of FIG. 5, one can see the schematic functioning of an improved buckle 22 according to the invention. The solid line represents the position of the lever, when the buckle is in the open position. The dotted lines represent the position of the lever when the buckle is in the closed position. In this case, the maximum tightening amplitude "d" is represented by the distance separating the two positions that the second axis 9 can occupy. This distance is equal to twice the value "e", which is the distance separating the first axis from the second axis, to which is added the value "L", which is the length of the elongated opening 19 ($d=2\times e+L$). Consequently, for the same center distance value "e", one has a tightening amplitude "d" that is much more substantial with an improved buckle according to the invention, even for the same value of tightening force.

Furthermore, for an equal tightening amplitude, the improved buckle according to the invention requires a reduced tightening force to be applied to the lever compared to a convention buckle. Indeed, the tightening force is directly proportional to the value of the lever arm, and this lever arm is equal to the value "e".

LIST OF ELEMENTS

1—boot
2—first flap
3—second flap
4—conventional buckle
5—cap
6—lever
7—first axis
8—linking rod
9—second axis
10—latch
12—attachment rack
13—leg
14—slot
15—pinion
16—base
17—tightening strap
18—side member
19—elongated opening
20—shell base
21—collar
22—improved buckle
23—first side
24—second side
25—rivet
26—support rack
27—plane of equilibrium

The invention claimed is:

1. A fastening buckle adapted to apply a tensioning force to tighten and/or close a first side of an article relative to a second side, said buckle comprising:
a cap adapted to be fixed on the first side;
a succession of teeth carried by the cap;
a lever pivotally mounted about a first axis relative to the cap;
a linking rod pivotally mounted on the lever about a second axis;
a pinion mounted for rotation about the first axis and being engaged with the succession of teeth carried by the cap;
the first axis being actuated, during tightening and/or closing the first side of the article relative to the second side, by a translational movement with respect to the first side by means of the rotation of the pinion while engaged with the succession of teeth carried by the cap.

2. A fastening buckle according to claim 1, further comprising:
an attachment rack having a plurality of teeth is adapted to be fixed on the second side;
a latch is affixed to said linking rod;
said latch, when closed, is engaged with one of the teeth of said rack.

3. A fastening buckle according to claim 1, wherein:
said cap includes two parallel side members;
an elongated opening is arranged in each of said parallel side members.

4. A fastening buckle according to claim 3, wherein:
said lever comprises two legs and a slot between said two legs;
said first axis is defined by two rivets, each of said rivets fixing one of said legs to one of said side members by extending through said elongated openings to enable the translational movement of said lever with respect to said first side.

5. A fastening buckle according to claim 1, wherein:
the succession of teeth carried by the cap are teeth of a support rack mounted on the cap.

6. A fastening buckle adapted to apply a tensioning force to tighten and/or close a first side of an article relative to a second side, said buckle comprising:
a cap adapted to be fixed on the first side;
said cap including two parallel side members;
an elongated opening being arranged in each of said parallel side members;
a lever pivotally mounted about a first axis relative to said cap;
a linking rod pivotally mounted on the lever about a second axis;
said first axis being actuated, during tightening, by a translational movement with respect to the cap;
the lever comprising two legs and a slot between the two legs;
the first axis being defined by two rivets, each of the rivets fixing one of the legs to one of the side members by extending through the elongated openings to enable the translational movement of the lever with respect to the first side;
a pinion equipped with a plurality of teeth being arranged at an end of each of the legs;
the cap including a support rack;
the teeth of the pinion being engaged with the teeth of the support rack so that pivoting movement of the lever about the first axis generates the translational movement of the first axis with respect to the cap.

7. A sports boot comprising:
a first side and a second side;
a fastening buckle for applying a tensioning force to tighten and/or close the first side relative to the second side about a wearer's foot or lower leg, said fastening buckle comprising:
a cap adapted to be fixed on the first side;
a succession of teeth carried by the cap;
a lever pivotally mounted about a first axis relative to the cap;
a linking rod pivotally mounted on the lever about a second axis;
a pinion mounted for rotation about the first axis and being engaged with the succession of teeth carried by the cap;
the first axis being actuated, during tightening and/or closing the first side of the sports boot relative to the second side, by a translational movement with respect to the first side by means of the rotation of the pinion while engaged with the succession of teeth carried by the cap.

8. A sports boot according to claim 7, wherein:
the succession of teeth carried by the cap are teeth of a support rack mounted on the cap.

9. A sports boot according to claim 7, further comprising:
an attachment rack having a plurality of teeth is adapted to be fixed on the second side;
a latch is affixed to the linking rod;
the latch, when closed, is engaged with one of the teeth of the rack.

10. A sports boot according to claim 7, wherein:

the cap includes two parallel side members;

an elongated opening is arranged in each of the parallel side members.

11. A sports boot according to claim 10, wherein:

the lever comprises two legs and a slot between the two legs;

the first axis is defined by two rivets, each of the rivets fixing one of the legs to one of the side members by extending through the elongated openings to enable the translational movement of the lever with respect to the first side.

12. A sports boot comprising:

a first side and a second side;

a fastening buckle for applying a tensioning force to tighten and/or close the first side relative to the second side about a wearer's foot or lower leg, said fastening buckle comprising:

a cap adapted to be fixed on the first side;

said cap including two parallel side members;

an elongated opening being arranged in each of said parallel side members;

a lever pivotally mounted about a first axis relative to said cap;

a linking rod pivotally mounted on the lever about a second axis;

said first axis being actuated, during tightening, by a translational movement with respect to the cap;

the lever comprising two legs and a slot between the two legs;

the first axis being defined by two rivets, each of the rivets fixing one of the legs to one of the side members by extending through the elongated openings to enable the translational movement of the lever with respect to the first side;

a pinion equipped with a plurality of teeth being arranged at an end of each of the legs;

the cap including a support rack;

the teeth of the pinion being engaged with the teeth of the support rack so that pivoting movement of the lever about the first axis generates the translational movement of the first axis with respect to the cap.

* * * * *